US005983759A

United States Patent [19]

Turner

[11] Patent Number: 5,983,759

[45] Date of Patent: Nov. 16, 1999

[54] FOLDING WRENCH CLUSTER

[76] Inventor: Paul E. Turner, 385 Grand Orchard St., Hopkinsville, Ky. 42240

[21] Appl. No.: 09/058,920

[22] Filed: Apr. 13, 1998

[51] Int. Cl.[6] ..... B25B 23/16

[52] U.S. Cl. ..... 81/177.6; 81/125.1

[58] Field of Search ..... 81/177.6, 177.1, 81/177.8, 125.1, 177.2

[56] References Cited

U.S. PATENT DOCUMENTS

| | | | |
|---|---|---|---|
| 544,738 | 8/1895 | Martin | 81/125.1 |
| 992,873 | 5/1911 | Higgins | 81/125.1 |
| 1,003,997 | 9/1911 | Dudly, Sr. . | |
| 1,186,807 | 6/1916 | Litomy . | |
| 1,402,373 | 1/1922 | Palmer . | |
| 1,503,084 | 7/1924 | Bain . | |
| 1,605,667 | 11/1926 | Laflin | 81/125.1 |
| 2,097,361 | 10/1937 | Bagley . | |
| 2,466,884 | 4/1949 | English et al. . | |
| 4,269,311 | 5/1981 | Rich . | |
| 4,606,247 | 8/1986 | Graham . | |
| 5,557,992 | 9/1996 | Macor | 81/125.1 |

FOREIGN PATENT DOCUMENTS

| | | |
|---|---|---|
| 2107628 | 8/1971 | Germany . |
| 294821 | 6/1936 | Italy . |

*Primary Examiner*—David A. Scherbel
*Assistant Examiner*—Joni B. Danganan
*Attorney, Agent, or Firm*—Richard C. Litman

[57] ABSTRACT

A folding wrench cluster may include at least four wrenches of different sizes and/or configurations, each selectively extendible from a single body portion. The body portion comprises a flat plate with a wrench secured to a pivot point extending from each side at each end of the body. The pivot points are laterally offset from the longitudinal centerline of the body. A laterally offset stop pin also extends from each side at each end of the body, with the stop pins being opposite the wrench pivot points. The stop pins are positioned to limit the arcuate motion of the wrenches when they are unfolded, so each wrench is closely aligned with the elongate body plate when it is fully extended, with the body plate serving as an extension handle. Spacers are provided between adjacent body plates or retaining members, to allow for a relatively thick wrench head for greater durability for the tool. The eye formed in the wrench handle for attachment to the pivot pin is also relatively heavy in order to absorb the shear stresses when torque is applied to the wrench and extended handle. Additional embodiments may include a plurality of plates each sandwiching two wrenches therebetween for further versatility, and a body plate having two wrench pivot points extending from each side at each end, with a stop pin disposed between each of the wrench pivot points on each side at each end, to effectively double the number of wrenches in a wrench cluster.

19 Claims, 4 Drawing Sheets

FOLDING WRENCH CLUSTER

BACKGROUND OF THE INVENTION

1. Field of the Invention

The present invention relates generally to hand tools, and more specifically to a combination tool comprising a plurality of open or box end wrenches, all pivotally connected to a common central plate or plates which serves as an extension handle for an unfolded wrench. Stop means is also provided to lock a selected wrench in a fully extended position as desired.

2. Description of the Related Art

All persons who have had occasion to work with threaded fasteners, recognize the need for a wrench or wrenches which are capable of accommodating a wide variety of sizes of hexagonal bolt heads and nuts. Essentially two alternatives have been provided in the past: Either (1) the adjustable wrench, or (2) a plurality of separate wrenches, each having a different size.

While the adjustable wrench has its place in a mechanic's tool box, it is generally not considered suitable for most work due to the lack of precision provided in such tools to allow for the adjustability. The jaws are all too easily shifted from a precise fit on the fastener, and may round off the corners of a fastener to which they are applied.

While a complete set of separate open or box end wrenches of good quality obviates the above problem, the result is more complex due to the sheer number of individual tools which must be carried. A set of metric wrenches, for example, would number approximately fifteen wrenches in order to cover all of the fastener sizes which are in more or less common use up to about one inch in diameter. And this only covers metric sizes, with fractional inch fasteners requiring another complete set of about the same quantity. Obviously, it is very easy to misplace a wrench from a set from time to time, thus adding to the expense for a mechanic to maintain a complete set of tools, meanwhile at least inconveniencing the mechanic until the missing wrench can be replaced.

Accordingly, a need will be seen for a folding wrench cluster, incorporating several commonly used sizes of open or box end wrenches in a single unit. The wrench cluster must provide for the folding of the wrenches into a relatively compact unit for storage when not in use, preferably of sufficiently small size to allow the cluster to be carried easily in a pocket. Yet, the device must provide for the extension of a selected wrench from the cluster to a practicable working length in order to provide the leverage required of such tools. Also, the cluster must provide a positive locking means when a selected wrench is extended, in order to provide sufficient rigidity for the unit in its extended state.

A discussion of the related art of which the present inventor is aware, and its differences and distinctions from the present invention, is provided below.

U.S. Pat. No. 1,003,997 issued on Sep. 26, 1911 to Albert Dudly, Sr., titled "Wrench," describes a folding double open end wrench unit, in which the two wrenches are secured to one another by a slip joint. When the two wrenches have been opened relative to one another, they are extended along their mutual longitudinal axis in order to lock them in an extended position. This system requires two manipulations of the device in order to first extend and then to lock the wrenches in the extended configuration, with the two manipulations being reversed for folding. Also, the Dudly, Sr. wrench configuration cannot be expanded to provide more than two wrenches in a single assembly, which would still require a relatively large number of dual wrench units. The present invention may provide any practicable number of wrenches as desired, for greater versatility.

U.S. Pat. No. 1,186,807 issued on Jun. 13, 1916 to John L. Litomy, titled "Tool," describes a multiple wrench tool wherein each of the wrenches is secured in a common holder by an elongate slot in each wrench, forming a slip joint. As in the Dudly, Sr. wrenches discussed immediately above, each of the Litomy wrenches is relatively thin, with the handle portion being as thick as the head portion of each wrench. This is a relatively light duty construction, and is not as durable as the wrench configuration of the present invention, wherein each of the wrenches has a relatively thicker head for greater strength. Moreover, Litomy provides for multiple sizes in each of his wrench heads, thus requiring each head to be relatively large in diameter and bulky.

U.S. Pat. No. 1,402,373 issued on Jan. 3, 1922 to Charles G. Palmer, titled "Combination Wrench," describes a tool having a single common handle or body portion with a plurality of wrenches secured thereto. The title "Combination Wrench" is not accurate in the present sense of the term, as all of the wrenches of the Palmer assembly are open end wrenches, rather than being a combination of an open end and closed end wrench each having the same wrench size, as the term is presently used. Palmer describes a cam type locking system to hold a selected wrench in an open position, but such a system is prone to slippage, as it does not provide a positive stop as does the extension lock of the present wrench cluster. Again, the Palmer wrenches are all relatively thin stampings offering relatively little gripping strength in the head portions, as in the other wrenches discussed above. The present wrench cluster provides wrenches having heads of sufficient thickness to provide substantial strength and durability.

U.S. Pat. No. 1,503,084 issued on Jul. 29, 1924 to Foree Bain, titled "Wrench," describes an open end wrench assembly having a generally U-shaped clamp securing all of the wrenches together pivotally at one end thereof. The clamp also serves as a locking means to prevent a selected wrench from pivoting beyond a maximally extended position, but the handle means comprises the remaining wrenches in the assembly, rather than there being a separate handle provided. Again, as in the other wrench assemblies discussed above, each of the Bain wrenches is relatively thin, offering relatively low structural strength compared to the present wrenches.

U.S. Pat. No. 2,097,361 issued on Oct. 26, 1937 to John J. Bagley, titled "Wrench," describes an assembly of flat, thin wrenches extending from each end of a flat central bar member, which is also configured as a wrench. Each of the wrenches is secured to one or the other side of the bar by a transverse hinge. As the hinge pin is in the plane of rotation of the wrenches, it serves as a lock to preclude folding of the wrenches when in use. However, the relatively thin hinge pin does not provide particularly good strength for such a purpose, in comparison to the extension locking means of the present wrench cluster. Also, the Bagley wrenches are each formed of a relatively thin, flat stamping or the like, with the problem of structural strength in such relatively thin components having been noted in each of the other devices of the related art discussed above. Moreover, the central bar of the Bagley assembly precludes complete folding of the assembly, thus precluding any particularly compact storage for the device, whereas the present folding wrench cluster may be compactly folded for carriage in a pocket or the like if desired.

U.S. Pat. No. 2,466,884 issued on Apr. 12, 1949 to Harvey W. English et al., titled "Open Ended Multiple Wrench Holder," describes a plural wrench assembly wherein each of the wrenches may be telescopingly extended from a central holder portion. No pivoting action is provided by English et al., as provided in the present invention. As in the other devices discussed above, the English et al. wrenches are each formed of relatively thin, flat stampings having comparatively little strength in the head portions.

U.S. Pat. No. 4,269,311 issued on May 26, 1981 to Jackson E. Rich, titled "Portable Hand Carried Kit For A Set Of Wrenches And The Like," describes an elongate box-like closure having a transverse pin therethrough, with a plurality of wrenches pivotally extendible from the pin when the box is opened. At least one slot extends across the end of the box when it is closed, for securing a selected wrench in the extended position for work. The box structure is relatively long, as it must provide for the complete enclosure of all of the wrenches when they are folded for storage. The same problem as discussed above is apparent with the Rich wrench assembly, in that each of the Rich wrenches is formed of a relatively thin, flat stamping offering comparatively little structural strength for providing the required torque to secure or unfasten a threaded nut or bolt. The wrenches of the present invention each have a considerably thicker head, and provide significantly greater strength.

U.S. Pat. No. 4,606,247 issued on Aug. 19, 1986 to Charles H. Graham, titled "Versatile Chained Tool Set," describes a tool comprising a series of interconnected links forming a closed loop, loosely similar to a roller chain loop. Each of the links has a wrench head formed integrally therewith, or some other tool component extending therefrom. The device is intended to fold flat when not in use, or to use the folded flat loop as a handle for an extended tool. The wrench heads are accordingly relatively thin in order to provide for compact folding, resulting in a reduction of strength in comparison to the thicker heads of the present tool.

Italian Patent Publication No. 294,821 published in June, 1936 illustrates a wrench comprising a single socket extension which is foldable along a transverse handle. Foldable handle extensions are provided at each end of the transverse handle. No multiple wrenches are apparent, and the device does not appear to be adaptable to open or box end wrenches, as provided by the present invention.

German Patent Publication No. 2,107,628 published on August 26, 1971 illustrates a foldable combination screwdriver and nut driver. The basic structure comprises a hollow stem with two arms foldably extendible therefrom to form a T in their extended positions. Each of the three components forming the T includes a socket wrench at its distal end. The stem of the T is hollow for housing a square drive shaft providing for the attachment of additional tool heads or the like thereon. While the square drive shaft provides for the removable attachment of an open end wrench head thereto, no multiple open or box end wrenches are disclosed, nor is any combination of two or more wrenches disclosed which have a common pivotal axis, as in the present folding multiple wrench cluster.

None of the above inventions and patents, taken either singly or in combination, is seen to describe the instant invention as claimed.

SUMMARY OF THE INVENTION

The present invention comprises a folding wrench cluster having at least one central body or handle portion with at least two wrenches pivotally extendible from each end of the handle portion. The pivot points at each end are offset from the centerline of the handle, with an oppositely offset stop pin passing through the handle portion adjacent each wrench pivot point. When any of the wrenches are completely unfolded and extended, the base of the wrench adjacent the pivot point contacts the stop pin, thereby locking the wrench at its maximum extension angle with its elongate axis parallel to the elongate axis of the handle or body portion, enabling the body portion to be used as an extension handle for the wrench.

Multiple handle or body plates may be assembled to sandwich at least two additional wrenches between each plate for further versatility, if desired. Spacers are preferably provided at each of the stop pin positions and at each of the wrench pivot points, to provide sufficient space between each plate or retaining element to allow for a relatively thick wrench head for a more durable tool. Also, sufficient space is provided for a substantial eye disposed in each of the wrench pivot ends, to accept the relatively high bending loads imposed by the body portion on the wrench when it is extended for use as a handle. Additional embodiments may comprise one or more plates having a longitudinally central stop pin at each end, with wrenches disposed to each side of the stop pin at each end to effectively double the capacity of the tool.

Accordingly, it is a principal object of the invention to provide an improved folding wrench cluster comprising at least one central plate having one wrench pivotally secured to each side at each end of the plate.

It is another object of the invention to provide an improved folding wrench cluster wherein each wrench attachment point is laterally offset from the longitudinal axis of the central plate, with the central plate including stop pin means extending to each side of the plate and laterally offset from the longitudinal axis of the plate, for stopping the arcuate motion of each wrench when extended generally parallel to the length of the plate to lock the wrench in alignment with the handle plate.

It is a further object of the invention to provide an improved folding wrench cluster including spacer means disposed at the stop pins and pivot points for the wrenches, thereby providing sufficient space between adjacent plates or retaining members for wrenches having relatively thick heads for greater durability.

An additional object of the invention is to provide an improved folding wrench cluster wherein each of the wrenches includes a relatively large diameter and thick eye to absorb the shear stresses imposed at the pivot pin during use.

Still another object of the invention is to provide an improved folding wrench cluster including two or more body plates, with at least two wrenches sandwiched between each of the adjacent body plates in order to provide a more versatile tool.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises different embodiments of a folding wrench cluster, with the basic theme of the invention being a central body or handle portion comprising one or more flat plates, with the plate or plates having a plurality of wrenches pivotally attached thereto. Each of the wrench pivot points is adjacent a stop pin which serves to lock the associated wrench in an extended position, essentially in line with the handle portion or plate(s) to provide additional leverage. The wrenches pivot back to lie adjacent the plate(s) when not in use.

Figure 1:
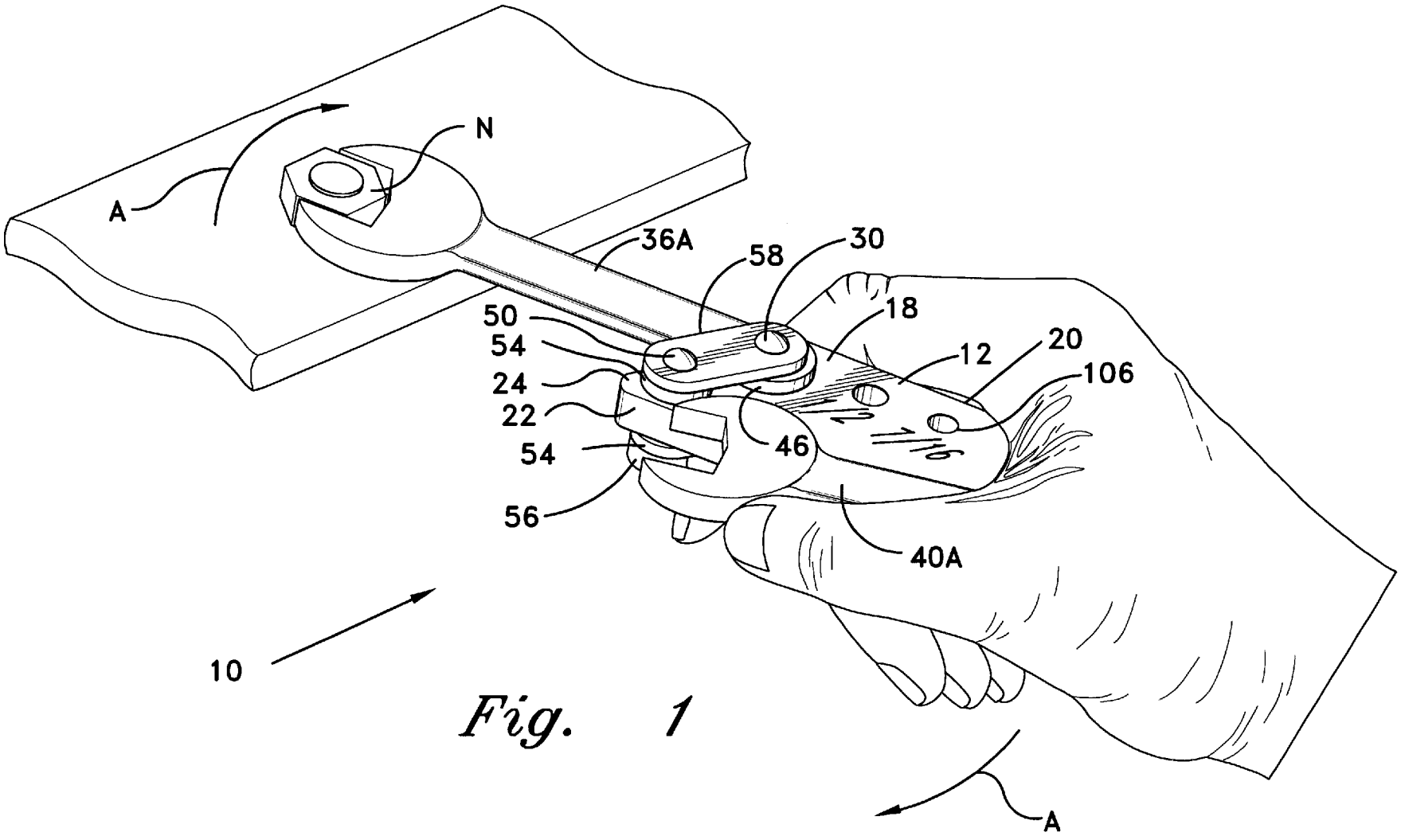
FIG. 1 is an environmental perspective view of a first embodiment of the present folding wrench cluster, showing its operation and use.
Figure 2:
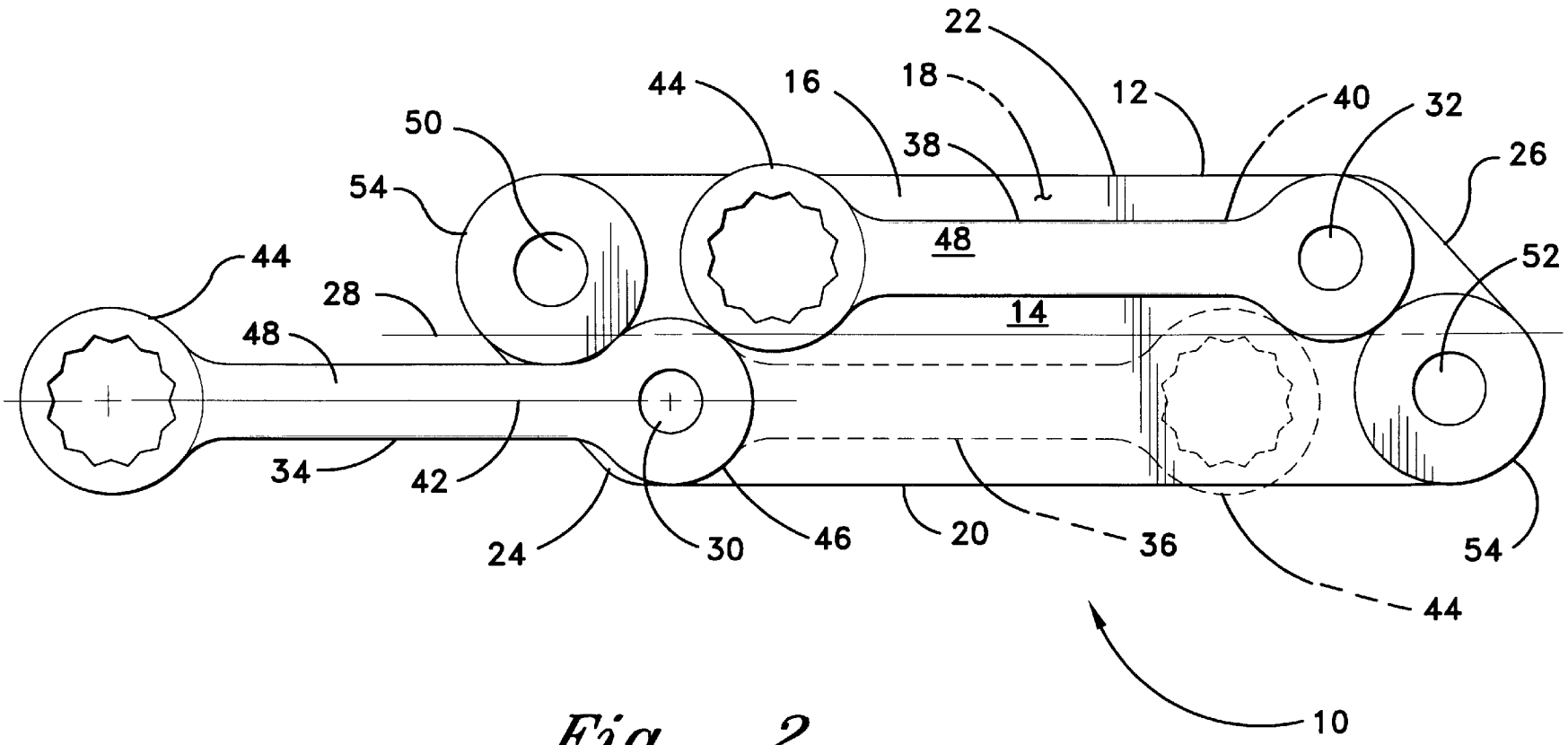
FIG. 2 is a top plan view of a folding wrench cluster embodiment with the retaining members removed for clarity, showing the locking alignment of an extended wrench against the corresponding stop pin.
Figure 4:
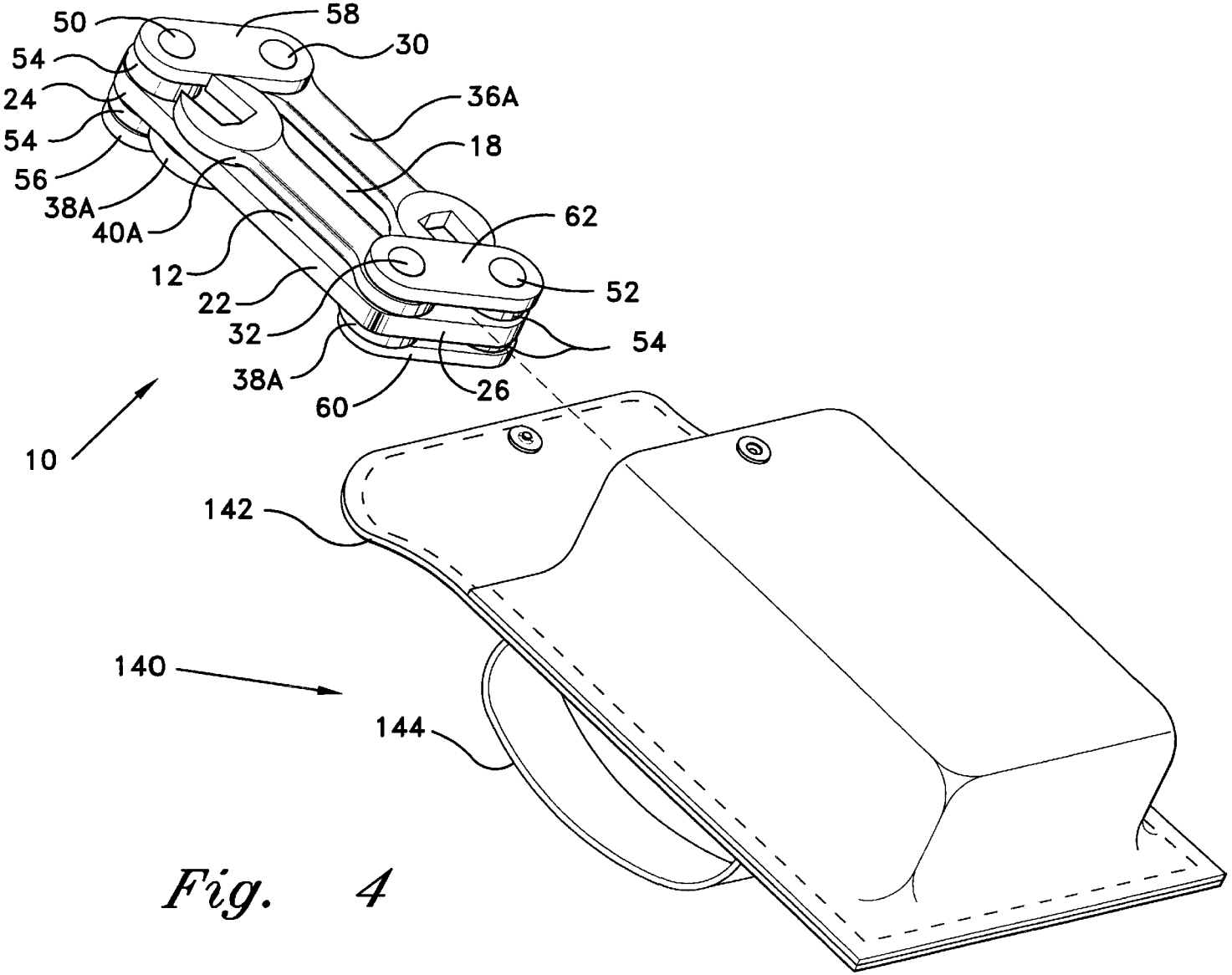
FIG. 4 is a perspective view of a folded wrench cluster of the first embodiment and a carrying case or pouch for storage of the wrench cluster.

FIGS. 1, 2, and 4 disclose a first embodiment 10 of the present folding wrench cluster, with the wrench cluster of FIG. 2 differing from that of FIGS. 1 and 4 by having a plurality of box end wrenches while the wrench cluster 10 of FIGS. 1 and 4 includes a series of open end wrenches. The principle of the present wrench cluster 10 is the same, regardless of the specific type of wrenches incorporated therewith. The wrench cluster 10 includes only a single central body portion or plate 12, with four wrenches pivotally attached thereto. The plate 12 may be formed in the general shape of a parallelogram with rounded corners, as shown in FIG. 2, in order to fit the arrangement of the wrench pivot and stop pins described further below. The plate 12 has a central area 14, a first side 16, an opposite second side 18, a first edge 20, an opposite second edge 22, a first end 24, an opposite second end 26, and a longitudinal centerline 28, each of which will be used to describe certain features of the invention further below.

A pair of wrench pivot pins extend through the plate 12, with a first pivot pin 30 passing through the first end 24 of the plate 12 and adjacent the first edge thereof, and an opposite second pivot pin 32 passing through the second end 26 of the plate 12 adjacent the second edge 22 thereof, so that the two wrench pivot pins 30 and 32 are approximately diagonally separated from one another on the plate 12. The pins 30 and 32 may comprise solid rivets, high grade or corrosion resistant steel bolts with mating nuts, or other suitable means of securing wrenches to the plate 12 so the wrenches may be swiveled or pivoted inwardly and outwardly from the body plate 12. Preferably, the plate 12 and other components of the present tool are formed of corrosion resistant steel (i. e., "stainless" steel), a hard tool steel, or other suitable material for optimum strength and durability.

Each of the pins 30 and 32 holds two wrenches pivotally secured thereto, as shown in FIG. 2, with the first pin 30 having a first wrench 34 adjacent the first side 16 of the plate 12, and a second wrench 36 adjacent the opposite second side 18 of the plate 12. The second pin 32 pivotally secures a third wrench 38 adjacent the first side 16 of the plate 12, and a fourth wrench 40 adjacent the opposite second side 18 of the plate 12. (As both the third and fourth wrenches 38 and 40 are folded along the plate 12, it will be seen that the fourth wrench 40 is concealed behind the third wrench 38 in FIG. 2. Also, while the first through fourth wrenches 34 through 40 of FIG. 2 are box end wrenches, it will be seen that the present tool may be constructed with any type of wrench.)

Each of the wrenches 34 through 40 has a longitudinal axis 42, as indicated on the first wrench 34 in FIG. 2, as well as a head portion 44, an attachment eye portion 46, and a shank portion 48 connecting the head portion 44 and attachment eye portion 46. Preferably the head and attachment eye portions 44 and 46 of each of the wrenches 34 through 40, as well as other wrench embodiments discussed further below, are relatively thicker than the shank portion 48 (as shown in the perspective views of the embodiments of FIGS. 1 and 4) and have larger diameters than the width of the shank portion 48, to provide the required strength for torquing a bolt or nut, and to provide the strength needed at the attachment pins 30 and 32 for good strength and durability for the tool.

First and second stop pins 50 and 52 extend through the plate 12, respectively adjacent the first wrench pivot pin 30 and second wrench pivot pin 32, i. e., the first stop pin 50 passes through the plate 12 adjacent the first end 24 and second edge 22 thereof, while the opposite second pivot pin 52 passes through the plate 12 adjacent the second end 26 and first edge 20 thereof. It will be seen that each of the stop pins 50 and 52 is disposed farther from the center 14 of the plate 12 than their respective adjacent wrench pivot pins 30 and 32, with the pivot pins 30, 32 and stop pins 50, 52 thus defining a general parallelogram configuration, as noted further above. Also, each stop pin 50 and 52 may include a spacer or bushing 54 therearound, with the spacers 54 being at least as thick as the head and attachment eye portions 44 and 46 of the wrenches, as shown more clearly in FIG. 1.

The spacers 54 are multipurpose, in that their thicknesses provide sufficient space between the plate 12 and overlying retainers (discussed below) to allow for the thickness of the attachment eye portions 46 and head portions 44 of the wrenches 34 through 40 to pivot freely and to nest in a folded position against the plate 12, without the thickness of the wrench heads 44 binding or otherwise interfering with the folding action of the wrenches 34 through 40. Also, the relatively large diameter of the bushings or spacers 54 provide a relatively large bearing area for the base of the shank of each wrench 34 through 40 when any given wrench 34 through 40 is extended for use, for greater durability of the tool.

Figure 3:
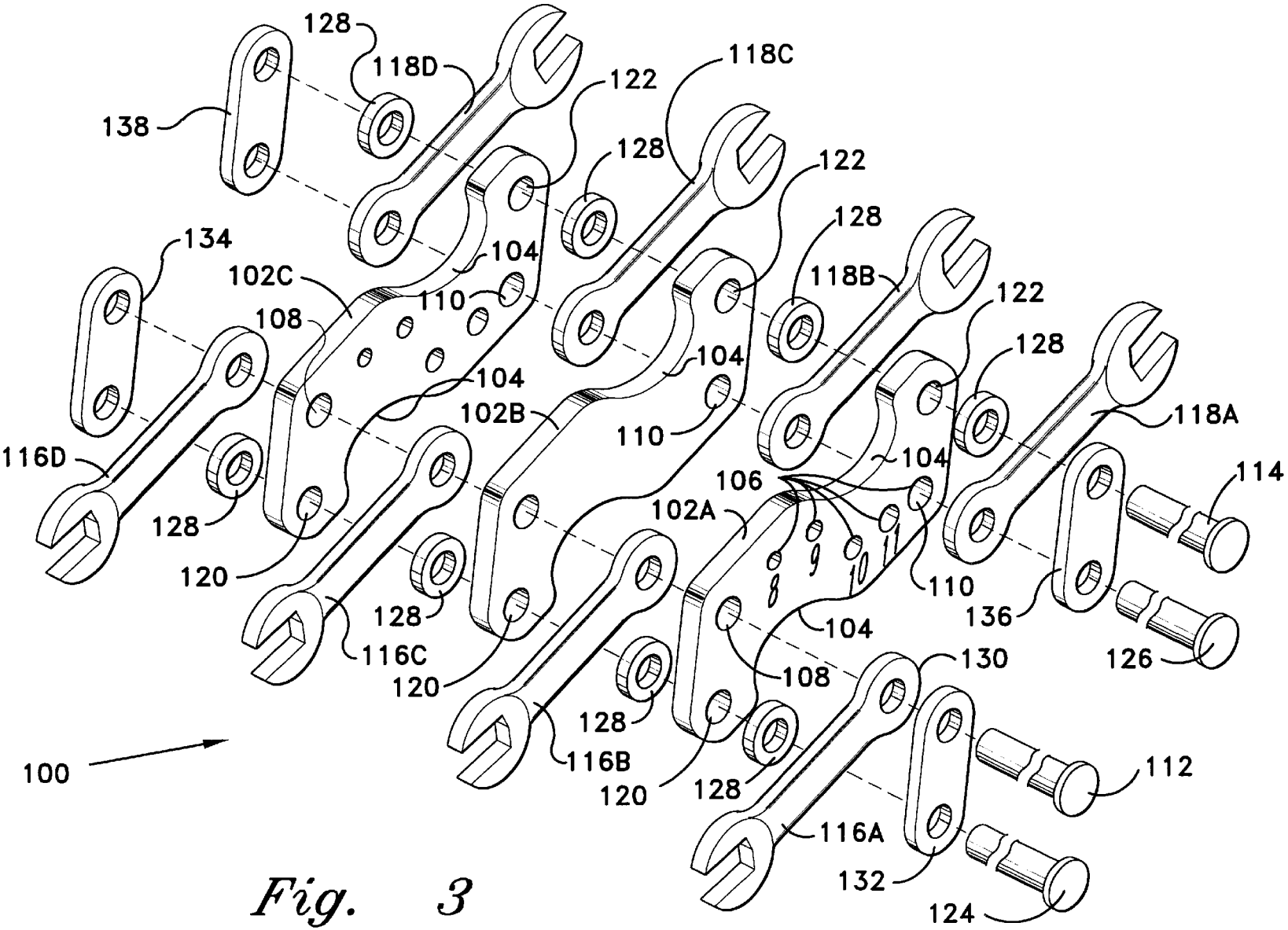
FIG. 3 is an exploded perspective view of an alternative embodiment having a plurality of body plates therein, with an additional pair of wrenches disposed between each of the plates.

Further strength for the present folding wrench cluster 10 is provided by first through fourth retaining members, respectively 56 through 62, installed over the pivot pins 30 and 32 of the respective first through fourth wrenches, e. g., wrenches 34*a* through 40*a* of FIGS. 1 and 3. (These retainers are not shown in FIG. 2, for clarity in the drawing figure to show the relative positions of the folded and extended wrenches more clearly and their bearing against their respective stop pins and spacers.) Each of the retainers 56 through 62 passes over its respective wrench and connects the corresponding wrench pivot pin with the adjacent stop pin, e. g., the second retainer 58 connects the first pivot pin 30 with the first stop pin 50 to capture the second wrench 36*a* between the retainer 58 and second side 18 of the plate 12, thus dividing any bending load on the first pivot pin 30 between the first pivot pin and adjacent stop pin 50.

The tool 10 of FIGS. 1 and 4 is constructed similarly to the tool of FIG. 2, the only difference being the provision for open ended wrenches, rather than the box end wrenches shown in FIG. 2. Also, the tool 10 of FIGS. 1 and 4 is shown inverted relative to the tool of FIG. 2, with the first edge 20 being positioned adjacent the index finger of the user of the tool, and the opposite second edge 22 lying adjacent the thumb of the hand in FIG. 1.

The second open end wrench 36*a* of tool 10 of FIG. 1 has been extended by pivoting it counterclockwise from its folded position adjacent the first edge 20 and second side 18 of the plate 12, to its maximally extended position where it is restrained from further pivoting in a counterclockwise direction due to the first stop pin 50 and its spacer 54. This stop position for the wrench 36*a* (and other extended wrenches of the embodiments of the present tool) positions the longitudinal axis of the wrench (e. g., the axis 42 of wrench 34 of FIG. 2) substantially parallel to the elongate axis or centerline 28 of the body plate 12, thus allowing the plate 12 (and the other wrenches folded thereagainst) to serve as an extension handle for the extended wrench, as shown in FIG. 1. It will be seen that for clockwise rotation of a threaded fastener, e. g., the nut N of FIG. 1, with rotation being indicated by the arrows A, the tool would be positioned with the second and fourth wrenches 36*a* and 40*a* facing upwardly. For counterclockwise rotation, the tool need only be turned over to provide the proper locking direction with the selected wrench bearing against the adjacent stop pin and spacer during the operation.

FIG. 3 illustrates an exploded perspective view of another embodiment of the present folding cluster wrench having a plurality of plates capturing a series of wrenches therebetween, as well as including further wrenches disposed to the outside of the outermost plates. This configuration, designated as folding wrench cluster 100, provides even greater versatility than the four wrench cluster 10 of FIGS. 1, 2, and 4, as an even greater number of wrenches of different sizes may be included in a single tool. While a series of three plates, comprising a first plate 102*a*, an intermediate plate 102*b*, and a last plate 102*c*, are shown, it will be understood that any practicable number of such plates may be provided, with each two adjacent plates capturing two wrenches therebetween. Thus, the present folding wrench cluster invention would include a number of wrenches equal to twice the number of plates plus two wrenches, or in the example of FIG. 3, a three plate cluster would contain six plus two or eight wrenches.

Each of the plates 102*a* through 102*c* is generally configured as the plate 12 of the wrench 10 embodiment of FIGS. 1, 2, and 4, with opposite first and second sides, opposite first and second edges, and opposite first and second ends and preferably having a generally parallelogram shape with rounded corners for comfort in the hand of a user of the tool. The plates 102*a* through 102*c*, as well as all other components of the wrench cluster 100, are preferably formed of suitable materials for such use, i. e., corrosion resistant steel, tool steel, etc.

It will be noted that each of the plates 102*a* through 102*c* of FIG. 3 includes an indentation 104 along each opposite elongate edge. These indentations are for the purpose of providing access to wrenches captured between any two of the plates, for ease of extension of those wrenches as desired. (It should be understood that the single plate wrench cluster embodiment 10 of FIGS. 1, 2, and 4 could also include such wrench access indentations, if so desired, but the need is not so critical in tool 10 having only a single plate 12, as all of the wrenches are disposed to the outside of the single plate.)

Another feature which may be included in the embodiments 10 or 100 of the present folding wrench cluster tool, is a series of holes or passages 106 formed in the plate(s) for determining the size or gauge of the bolt or fastener to which a given wrench is to be applied. As practically all bolts and fasteners are provided in a series of standard metric or fractional inch sizes which also correspond to the size or diameter of the (normally) hexagonal head of the fastener, such gauge passages 106 may be used to determine the diameter of the fastener on which one of the wrenches of the present tool is to be used. The gauge size holes 106 may be marked with the size of the appropriate wrench jaw width corresponding to the different size wrenches of a particular tool, as shown in FIGS. 1 and 3, rather than with the diameter of the fastener. It will be seen that the present tool is applicable to use with fractional inch size fasteners, as indicated by the markings in FIG. 1, as well as metric sizes, as indicated in FIG. 3.

Each plate 102*a*, 102*b*, and 102*c* has a first and a generally diagonally opposite wrench pivot pin passage therethrough, respectively passages 108 and 110. (Similar passages, not shown, are obviously provided through the plate 12 of the first embodiment wrench cluster tool 10 shown in its assembled state in FIGS. 1, 2, and 4.) The passages 108 and 110 have corresponding first and second wrench pivot pins, respectively 112 and 114, installed therethrough. The pins 112 and 114 serve to secure the plurality of plates 102*a*, 102*b*, and 102*c* together, as well as serving to capture the plurality of wrenches between and on the plates.

Each of the pins 112 and 114 secures a group of wrenches to and between the plates 102*a* through 102*c*, with the first pin 112 capturing a first group of wrenches comprising a first wrench 116*a* disposed adjacent the first or outer side of the first plate 102*a*, a first intermediate wrench 116*b* between the first and intermediate plates 102*a* and 102*b*, a second intermediate wrench 116*c* between the intermediate and last plates 102*b* and 102*c*, and a last wrench 116*d* adjacent the second or outer side of the last plate 102*c*. The second group of wrenches, comprising wrenches 118*a* through 118*d*, is pivotally secured on the second wrench pivot pin 114 to and between the plates 102*a* through 102*c*, in corresponding order to the wrenches 116*a* through 116*d* of the first wrench group. The wrenches 116*a* through 118*d* may be either open or box end, or a combination thereof, and each is preferably a different size (either metric or fractional inch, or perhaps one fractional inch size group and another metric size group) for versatility.

Plates 102*a* through 102*c* also include first and second stop pin passages, respectively 120 and 122, therethrough. The stop pin passages 120 and 122 are disposed generally diagonally opposite one another and somewhat farther from the centers of the plates 102*a* through 102*c* than the wrench pin passages 108 and 110 to place the wrench pivot pins 112 and 114 and their respective stop pins 124 and 126 in the proper relationship, i. e., defining a parallelogram shape. This relationship is the same as was described further above for the wrench cluster 10 embodiment of FIGS. 1, 2, and 4, with its wrench pivot pins 30 and 32 and stop pins 50 and 52. It will be seen that each of the passages 108, 110, 120, and 122 are congruent with one another when the plates 102*a* through 102*c* are assembled together, with the plates 102*a* through 102*c* being held in a congruent relationship by the pins 112, 114, 124, and 126.

The two stop pins 124 and 126 preferably include a plurality of bushings or spacers 128 disposed therealong, for the same purposes as the spacers 54 of the first embodiment of FIGS. 1, 2, and 4. It will be noted that the attachment eyes of each of the wrenches, e. g., the attachment eye 130 of the first wrench 116*a*, not only has a larger diameter than the shank of the wrench for good strength, but is also somewhat thicker, preferably at least as thick as the corresponding head of the wrench. (Spacers may alternatively be used to provide the desired thickness.) This allows the thicker wrench head to fold adjacent to or between the corresponding plate(s) 102*a* through 102*c*, for compact storage of the tool, as in the embodiment 10 of FIGS. 1, 2, and 4.

The bushings or spacers 128 also provide a greater bearing area for the corresponding wrenches 116*a* through 118*d* against their associated stop pins 124 and 126, when a selected wrench is extended to its maximum extent with its centerline essentially parallel to the longitudinal axis of the plates 102*a* through 102*c*, essentially as shown for the first embodiment tool 10 in FIG. 2. The bushings or spacers 128 will be seen to provide the proper diameter for the associated stop pin to stop the arcuate motion of the selected wrench essentially parallel to the elongate axes of the plates, as desired for maximum leverage when using the present tool.

As in the first embodiment tool 10 of FIGS. 1, 2, and 4 discussed further above, the multiple plate wrench cluster 100 of FIG. 3 includes first through fourth retaining members, respectively 132 through 138, disposed respectively over the first wrench 116*a* of the first wrench group, the opposite last wrench 116*d* of the first wrench group, the first wrench 118*a* of the second wrench group, and the last wrench 118*d* of the second wrench group. Each of these retainers 132 through 138 bridges across their respective wrench pivot pin ends to the corresponding stop pin end, and serves not only to capture and retain the first and last wrenches on their respective pivot pins, but also to divide any shear loads placed upon the pivot pins, between the pivot pins and their corresponding adjacent stop pins. Thus, the structure and function of the retainers 132 through 134 of the tool 100 of FIG. 3, are similar to corresponding components of the tool 10 embodiment.

In summary, the present folding wrench cluster, in its various embodiments 10 and 100, will be seen to provide a most desirable means of providing a plurality of wrenches of various sizes, in a single tool. By placing a series of wrenches of incrementally varying sizes in a single tool where they are permanently secured together, the loss of a single wrench is impossible, and the loss of the present tool is not likely due to its somewhat larger size than a single wrench. A carrying pouch 140, somewhat like that shown in FIG. 4, may be provided for greater security for any of the embodiments of the present wrench, if so desired. Such a pouch 140 may include a closure flap 142 or the like to preclude accidental loss of the wrench cluster from the pouch 140, and further security may be provided by means of a belt loop(s) 144 on the back of the pouch, if desired.

The present wrench cluster tool is particularly handy as the central plate or plates against which the wrenches fold, also serves as an extension handle for a selected wrench when that wrench is extended from the tool. The stop pins provided serve to preclude the arcuate extension of a selected wrench past its maximally extended point, where the elongate axes of the wrench and plate(s) are parallel to one another. This serves to lock the selected wrench in a maximally extended position when the wrench is used to torque a bolt head or nut. Yet, the wrench tool need only be inverted to reverse the orientation of the stop pin, to allow the wrench to be used in the opposite rotational direction on the fastener.

Other variations on the present tool are also possible. For example, each stop pin could serve two wrenches to each side of the associated plate. In other words, a stop pin could be centrally disposed through one end of the plate, with a wrench pivot pin disposed to each side of the stop pin. Such a configuration would double the number of wrenches which could be contained in a single wrench cluster tool, e. g., providing a total of eight wrenches from both ends of a single plate, or sixteen wrenches from a wrench cluster tool comprising three plates, etc.

Further details may be provided to enhance the utility of the present wrench cluster tool embodiments, if so desired. For example, some form of retaining means e. g., spring, etc.) might be provided to hold or retain each of the wrenches in their retracted positions until extended by a user of the present tool, and/or to hold a selected wrench in an extended position as desired. Such retaining means need not be particularly strong, but merely sufficient to overcome the weight and/or inertia of the wrenches so they do not fall from their retracted or selectively extended positions. Accordingly, the present folding wrench cluster tool in any of its embodiments will provide a most useful accessory for the amateur or professional mechanic or technician who has need to use a variety of different sizes of wrenches from time to time in his or her work.

It is to be understood that the present invention is not limited to the embodiments described above, but encompasses any and all embodiments within the scope of the following claims.

I claim:

1. A folding wrench cluster, comprising:

a single flat plate having a center, a first side, an opposite second side, a first edge, an opposite second edge, a first end, an opposite second end, and a longitudinal centerline;

a first wrench pivot pin extending through said first end of said plate adjacent said first edge thereof, and an opposite second wrench pivot pin extending through said second end of said plate adjacent said second edge thereof;

a first and a second wrench pivotally disposed upon said first wrench pivot pin respectively to said first side and to said second side of said plate, and a third and a fourth wrench pivotally disposed upon said second wrench pivot pin respectively to said first side and to said second side of said plate, with each said wrench having a longitudinal axis;

a first stop pin extending through said first end of said plate adjacent said second edge thereof, and an opposite second stop pin extending through said second end of said plate adjacent said first edge thereof; and said first and said second stop pin each being disposed respectively adjacent said first and said second wrench pivot pin and farther from said center of said plate than said first and said second wrench pivot pin, for stopping arcuate motion of a corresponding said wrench when said corresponding said wrench is fully extended with the respective said longitudinal axis of said corresponding said wrench being substantially parallel to said longitudinal centerline of said plate.

2. The folding wrench cluster according to claim 1, including first through fourth retaining members disposed upon said first and said second wrench pivot pin and said first and said second stop pin, respectively capturing said first through said fourth wrench between said retaining members and said plate.

3. The folding wrench cluster according to claim 1, wherein said first and said second wrench pivot pin and said first and said second stop pin define a parallelogram shape, and said plate is in the general form of a parallelogram.

4. The folding wrench cluster according to claim 1, wherein each said wrench includes a head portion, an attachment eye portion, and a shank portion, with said head portion and said attachment eye portion being thicker than said shank portion, including a plurality of spacers disposed upon each said stop pin and between said plate and each of said retaining members, with each of said spacers being at least as thick as said head portion and said attachment eye portion of each said wrench.

5. The folding wrench cluster according to claim 1, wherein each said wrench includes at least an attachment eye portion and a shank portion with a width, with each said attachment eye portion having a larger diameter than said width of said shank portion.

6. The folding wrench cluster according to claim 1, including at least one fastener size gauge hole formed through said plate.

7. The folding wrench cluster according to claim 1, including a storage pouch therefor.

8. The folding wrench cluster according to claim 1, wherein said first through said fourth wrench are selected from the group consisting of open end wrenches and box end wrenches.

9. The folding wrench cluster according to claim 1, wherein said first through said fourth wrench are selected from the group consisting of a first plurality of wrenches having different metric dimensions from one another and a second plurality of wrenches having different fractional inch measurements from one another.

10. A folding wrench cluster, comprising:

a plurality of parallel, spaced apart flat plates including at least a first plate and a last plate;

each of said plates having a center, a first side, an opposite second side, a first edge, an opposite second edge, a first end, an opposite second end, and a longitudinal centerline;

a first wrench pivot pin extending through each said first end of said plates adjacent each said first edge thereof, and an opposite second wrench pivot pin extending through each said second end of said plates adjacent each said second edge thereof;

a first group of wrenches each pivotally disposed upon said first wrench pivot pin, with said first group of wrenches including a first wrench disposed to said first side of said first plate, a last wrench disposed to said second side of said last plate, and an intermediate wrench disposed between each of said plates;

a second group of wrenches each pivotally disposed upon said second wrench pivot pin, with said second group of wrenches including a first wrench disposed to said first side of said first plate, a last wrench disposed to said second side of said last plate, and an intermediate wrench disposed between each of said plates;

each of said wrenches having a longitudinal axis;

a first stop pin extending through each said first end of said plates adjacent each said second edge thereof, and an opposite second stop pin extending through each said second end of said plates adjacent each said first edge thereof; and said first and said second stop pin each being disposed respectively adjacent said first and said second wrench pivot pin and farther from said center of each of said plates than said first and said second wrench pivot pin, for stopping arcuate motion of a corresponding one of said wrenches when said corresponding one of said wrenches is fully extended with the respective said longitudinal axis of said corresponding one of said wrenches being substantially parallel to said longitudinal centerline of each of said plates.

11. The folding wrench cluster according to claim 10, including:

a first and a second retaining member respectively disposed upon said first and said second wrench pivot pin and said first and said second stop pin, capturing said first wrench of said first group and said second group respectively between said first and said second retaining member and said first side of said first plate; and a third and a fourth retaining member respectively disposed upon said first and said second wrench pivot pin and said first and said second stop pin, capturing said last wrench of said first group and said second group respectively between said third and said fourth retaining member and said second side of said last plate.

12. The folding wrench cluster according to claim 10, wherein said first and said second wrench pivot pin and said first and said second stop pin define a parallelogram shape, and said plates are in the general form of a parallelogram and are mutually congruent.

13. The folding wrench cluster according to claim 10, wherein each of said wrenches includes a head portion, an attachment eye portion, and a shank portion, with said head portion and said attachment eye portion being thicker than said shank portion, including a plurality of spacers disposed upon each said stop pin and between each of said spaced apart plates, between said first and second retaining members and said first plate, and between said third and fourth retaining members and said last plate, with each of said spacers being at least as thick as said head portion and said attachment eye portion of each said wrench.

14. The folding wrench cluster according to claim 10, wherein each of said wrenches includes at least an attachment eye portion and a shank portion with a width, with each said attachment eye portion having a larger diameter than said width of said shank portion.

15. The folding wrench cluster according to claim 10, including a wrench access indentation formed in said first edge and said second edge of each of said plates.

16. The folding wrench cluster according to claim 10, including a plurality of fastener size gauge holes formed through at least said first plate.

17. The folding wrench cluster according to claim 10, including a storage pouch therefor.

18. The folding wrench cluster according to claim 10, wherein said wrenches are selected from the group consisting of open end wrenches and box end wrenches.

19. The folding wrench cluster according to claim 10, wherein said wrenches are selected from the group consisting of a first plurality of wrenches having different metric dimensions from one another and a second plurality of wrenches having different fractional inch measurements from one another.

* * * * *